US006883641B2

(12) United States Patent
Julien

(10) Patent No.: US 6,883,641 B2
(45) Date of Patent: Apr. 26, 2005

(54) MOBILE ELEVATOR WORKING AND LOAD-LIFTING PLATFORM

(76) Inventor: Romain Julien, 183 Lucien Thibodeau, Portneuf, (Québec) (CA), G0A 2Y0

( * ) Notice: Subject to any disclaimer, the term of this patent is extended or adjusted under 35 U.S.C. 154(b) by 160 days.

(21) Appl. No.: 10/226,567

(22) Filed: Aug. 16, 2002

(65) Prior Publication Data

US 2004/0035636 A1 Feb. 26, 2004

(51) Int. Cl.[7] ..... E06C 1/00; E04G 1/18; B66B 9/02

(52) U.S. Cl. ..... 182/69.1; 182/69.5; 182/141; 187/269; 248/421

(58) Field of Search ..... 182/69.1, 69.2, 182/69.3, 12–16, 141, 69.5, 69.6; 74/521; 52/109; 108/144–147; 248/277.1, 421; 254/122; 187/204, 243, 267, 269; 180/6.48, 6.5

(56) References Cited

U.S. PATENT DOCUMENTS

| | | | | |
|---|---|---|---|---|
| 27,914 A | | 2/1860 | King | |
| 1,577,989 A | | 3/1926 | Sieber | |
| 3,596,735 A | | 8/1971 | Denier | |
| 3,796,282 A | | 3/1974 | Denier et al. | |
| 4,113,065 A | * | 9/1978 | Sikli | 187/269 |
| 4,457,403 A | | 7/1984 | Ream | |
| 4,475,611 A | * | 10/1984 | Fisher | 180/6.5 |
| 4,691,795 A | * | 9/1987 | Wehmeyer et al. | 180/6.48 |
| 4,930,598 A | | 6/1990 | Murrill et al. | |
| 5,535,843 A | * | 7/1996 | Takeda et al. | 180/6.5 |
| 6,050,365 A | | 4/2000 | Newlin | |
| 6,390,213 B1 | * | 5/2002 | Bleicher | 180/65.1 |

* cited by examiner

*Primary Examiner*—Hugh B. Thompson, II
(74) *Attorney, Agent, or Firm*—F. Martineau

(57) ABSTRACT

A ground-movable load-lifting vehicle for lifting a load over ground. The vehicle comprises a platform bed, a ground-movable carriage, and an extendible scissor linkage assembly supporting the platform bed spacedly over the carriage. A hydraulic ram system enables power extension of the scissor linkage assembly against the bias of a load supported by said platform bed. The carriage further includes peripheral ground-engageable pivotal casters, rotatably mounted to the carriage in spaced apart fashion, and a pair of ground-engageable drive wheel assemblies, mounted for relative movement to a central portion of the carriage, wherein the drive wheel assemblies provide omnidirectional displacement capability for this load-lifting vehicle. A power unit, controlled by an electronic circuit, powers both the hydraulic rams of the scissor linkage assembly and the drive wheel assemblies.

9 Claims, 9 Drawing Sheets

MOBILE ELEVATOR WORKING AND LOAD-LIFTING PLATFORM

FIELD OF THE INVENTION

This invention relates to elevatable platforms supported by a ground movable carriage.

BACKGROUND OF THE INVENTION

It is known to provide movable and elevatable scaffold assemblies or lifts, for workmen in view of making installations of for example electrical wiring, heating ducts or the like in ceiling structures. Such movable/elevatable scaffold assemblies typically include a wheeled motorized base, a scissor linkage assembly, and a platform supported by the scissor linkage over the base. Hydraulic rams are connected to the scissor linkage in such a way that upon expansion of the hydraulic ram, the scissor linkage extends to elevate the platform. The motorized base usually includes a carriage carried over ground by a front wheel axle and a rear wheel axle, each axle carrying a pair of opposite wheels; and a drive motor driving one of the two front or rear axles.

The problem with such vehicles is to reconcile manoeuvrability with stability. Indeed, on the one hand, as a load is lifted by the platform, the center of gravity of the vehicle progressively moves away spacedly upwardly from the ground. With a higher center of gravity, the vehicle is less stable, particularly if the loading distribution over the platform is unequally provided. Prior art ways of controlling this instability include adding laterally spread apart outrigger wheels, being pivoted to the vehicle ground base and which may also be connected to hydraulic rams for swinging these outrigger wheels from an operative, ground-engaging condition to a raised condition alongside the base. These laterally extended outriggers are destined to prevent the accidental tipping over, swaying and/or tilting of the vehicle when the loaded platform is raised. In addition, to ensure fore and aft stability control of the vehicle, over and above the lateral stability control of the lateral outrigger wheel assembly, the front and rear axles of this vehicle should be as far away as possible from one another.

On the other hand, as the front and rear axles are spread apart for better vehicle stability, the turning radius of the vehicle increases, and thus, the manoeuvrability of the vehicle decreases, particularly in tight spots.

OBJECT OF THE INVENTION

The object of the invention is thus to improve upon manoeuvrability of elevatable platforms supported by a ground movable carriage, without substantially affecting the stability of the ground carriage.

SUMMARY OF THE INVENTION

In accordance with the object of the invention, there is disclosed a ground-movable carriage for supporting spacedly over ground a liftable platform with an extendable scissor linkage assembly, said carriage including: a) a rigid main frame, defining a front portion, a rear portion, and a middle portion intermediate said front portion and said rear portion; b) a first pair of ground-engageable front pivotal casters, rotatably mounted to said main frame front portion in laterally spaced apart fashion; c) a second pair of ground-engageable rear pivotal casters, rotatably mounted to said main frame rear portion in laterally spaced fashion; d) a ground-engageable omnidirectional drive wheel assembly, mounted for relative movement to said main frame middle portion; and e) a power unit, operatively connected to said drive wheel assembly and powering said drive wheel assembly in moving said carriage rollingly over ground; wherein said drive wheel assembly can provide full turn rotation of said carriage without fore and aft motion.

Tilt means may be added, cooperating with said drive wheel assembly in enabling downward tilt of said drive wheel assembly to accommodate uneven ground surface. Said drive wheel assembly could include a first wheel axle and a second wheel axle, each of said first wheel axle and second wheel axle being independently articulated to said carriage main frame by a first pivot mount system and by a second pivoted suspension system. A manual remote-control device could be added, operatively connected to said power unit for remotely actuating said drive wheel assembly.

Preferably, there is provided a first reduction gear assembly, connected to said first wheel axle, and a second reduction gear assembly, connected to said second wheel axle; and wherein said power unit includes a first motor, connected to said first wheel axle and cooperating with said first reduction gear assembly, and a second motor, connected to said second wheel axle and cooperating with said second reduction gear assembly; at least one of said first motor and second motor providing reversible torque output.

Preferably, an electronic circuit operatively interconnects said first and second motors, said first and second reduction gears, and said remote control device, said electronic circuit controlling direction of rotation of each of said first wheel axle and second wheel axle.

The invention also relates to a ground-movable load-lifting vehicle for lifting a load over ground, said vehicle comprising: a) a platform bed, for supporting and containing a load spacedly over ground; b) a ground-movable carriage, including a rigid main frame defining a front portion, a rear portion, and a middle portion intermediate said front portion and said rear portion; c) a scissor linkage assembly, supporting said platform bed spacedly over said carriage, said scissor linkage assembly including a first pivot mount, pivotally interconnecting a top end of said scissor linkage assembly to said platform bed, a second pivot mount, pivotally interconnecting a bottom end of said scissor linkage assembly to said carriage, and ram means for power extending said scissor linkage assembly against the bias of the load supported by said platform bed; wherein said carriage further includes:

a first pair of ground-engageable front pivotal casters, rotatably mounted to said main frame front portion in laterally spaced apart fashion;—a second pair of ground-engageable rear pivotal casters, rotatably mounted to said main frame rear portion in laterally spaced fashion; d) a ground-engageable omnidirectional drive wheel assembly, mounted for relative movement to said main frame middle portion; and e) a power unit, operatively connected to said drive wheel assembly and powering said drive wheel assembly in moving said carriage rollingly over ground; wherein said drive wheel assembly can provide full turn rotation of said carriage without fore and aft motion.

Preferably, said ram means are operatively connected to said power unit and to said remote control device, said power unit controlling said ram means concurrently with said drive wheel. In this case, the electronic circuit, integral to said carriage main frame could operatively interconnect said ram means and said power unit, wherein said drive wheel assembly of the carriage and said ram means of the scissor linkage assembly are selectively controled by said electronic circuit independently of one another.

The invention further relates to a ground movable vehicle having a rigid chassis defining a central area and a peripheral edge portion, a number of ground-engageable swivel casters rotatably mounted to said peripheral edge portion of said chassis in spaced apart fashion whereby said chassis is spacedly supported over ground, ground engageable drive wheel means to be mounted to said central area of said rigid chassis, mounting means mounting said drive wheel means to said central area of said rigid chassis for relative movement thereabout, and power means powering said drive wheel means for moving said movable vehicle over ground; wherein said mounting means provide omnidirectional displacement capability for said movable vehicle.

Preferably, there would then be provided a platform member, and a lifting member operatively interconnecting said platform member and said chassis, said platform member for supporting a load, said lifting member operatively connected to said power means.

DETAILED DESCRIPTION OF THE PREFERRED EMBODIMENT OF THE INVENTION

Figure 1:
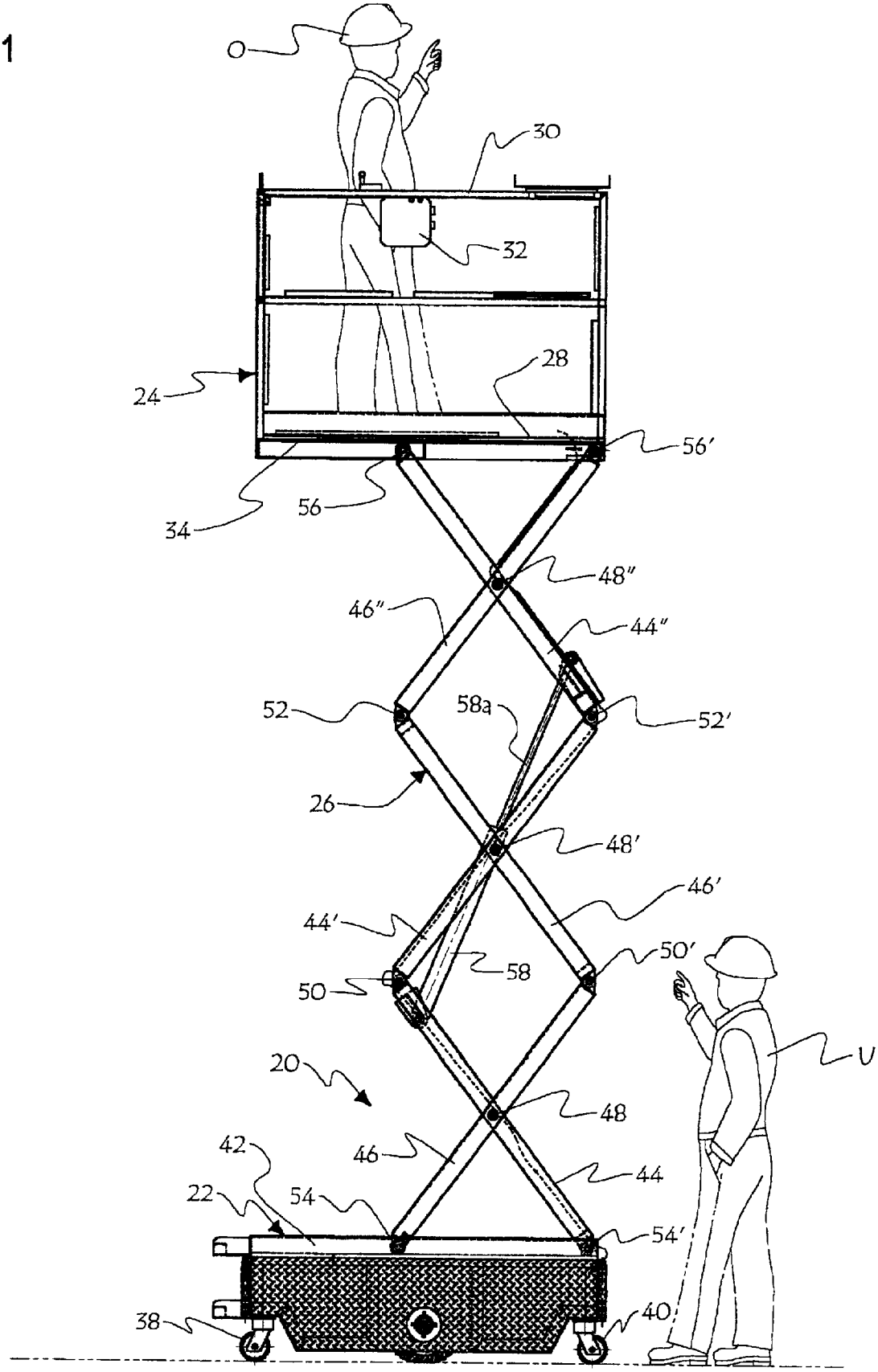
FIG. 1 is an elevational view of an elevating platform vehicle according to a preferred embodiment of the invention, showing a partly extended scissor linkage assembly supporting a platform over a ground movable carriage, and further showing in phantom lines a first operator standing on the raised platform and a second operator standing on the ground close to the ground movable carriage.

Elevating platform vehicle 20 illustrated in FIG. 1 generally consists of a ground carriage 22 at the bottom end, a platform 24 at the top end, and a scissor linkage assembly 26 interconnecting the carriage 22 and the platform 24.

Platform 24 defines a bottom platform bed 28, which supports upright guard ramp members 30. A remote-control vehicle control unit 32, detailed later, is mounted to an upper section of guard ramps 30, at arm's length for an operator O standing on the platform bed 28. A rail member 34 is provided against the underface of platform bed 28.

Figure 3:
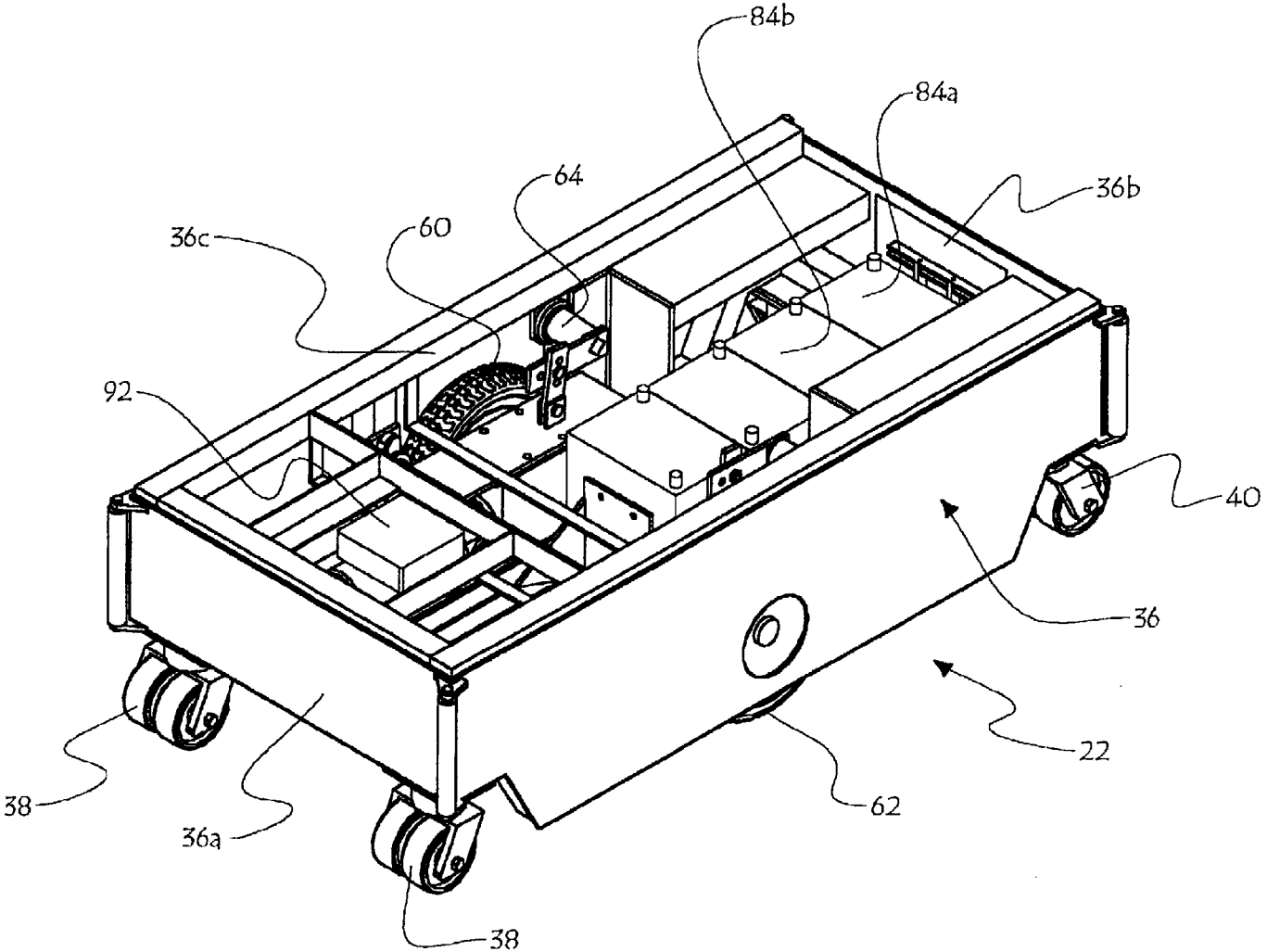
FIG. 3 is a front downwardly looking perspective view of the ground carriage of FIG. 1, including drive and outrigger wheels axles, but with the scissor linkage assembly and platform removed for clarity of the view.

Ground carriage 22, shown in FIG. 3, generally consists of a box-like rigid frame 36, defining a front end 36*a*, rear end 36*b*, and a middle portion 36*c* located intermediate the front end 36*a* and the rear end 36*b*. At each of the two opposite lateral sides of the front end 36*a* of carriage 22, is provided a swivel caster 38, 38; and at each of the two opposite lateral sides of the rear end 36*b* of carriage 22, is provided a swivel caster 40, 40; for a total of preferably four casters, although the total number of these peripheral casters is not critical and could be three, or five or more, provided these casters support the main frame 36 spacedly and rollingly over ground, in a stable fashion that will substantially prevent accidental tilt of the carriage 22 during normal use of the vehicle 20.

Another rail member 42, is provided on the top surface of the carriage main frame 36.

Scissor linkage assembly 26 is made from a number of serially interconnected cross-shape pairs of elongated first lever arms 44, 46, second lever arms 44', 46', third lever arms 44", 46", . . . the two lever arms from each pair being pivotally interconnected at their intermediate length section by a pivot mount 48, 48', 48", . . . The upper ends of lower lever arms 44, 46, are connected to the lower ends of lever arms 44', 46', respectively, by pivot mounts 50, 50'. The upper ends of lever arms 44', 46' are connected to the lower ends of lever arms 44", 46", respectively, by other pivot mounts 52, 52'; etc . . . The lower ends of the lowermost lever arms, 44, 46, carry pivotal sliders 54, 54', that are slidingly engaged into top rail member 42 of carriage 22. Sliders 54, 54', enable the spreading apart of the lower ends of lowermost lever arms 44,46, and thus downward retraction of the scissor linkage assembly 26; and also enable the progressive migration of these lower ends of lowermost lever arms 44, 46, and thus upward extension of the scissor linkage assembly 26.

The upper ends of the uppermost lever arms 44", 46", further carry pivotal sliders 56, 56', respectively, that are slidingly engaged into the bottom rail members 34 of platform bed 28. Upper sliders 56, 56' and lower sliders 54, 54', cooperate with their respective rail members 42, 42, 34, 34, in providing vertical motion of platform 24 relative to ground carriage 22.

Hydraulic ram means 58, including extensible piston rod 58*a*, pivotally interconnect intermediate sections of middle section lever arms from scissor linkage assembly 26, to provide power assist to the forcible upward extension of the scissor linkage assembly and associated upward displacement of the platform 24, in a fashion well known to those skilled in the art.

Figure 4:
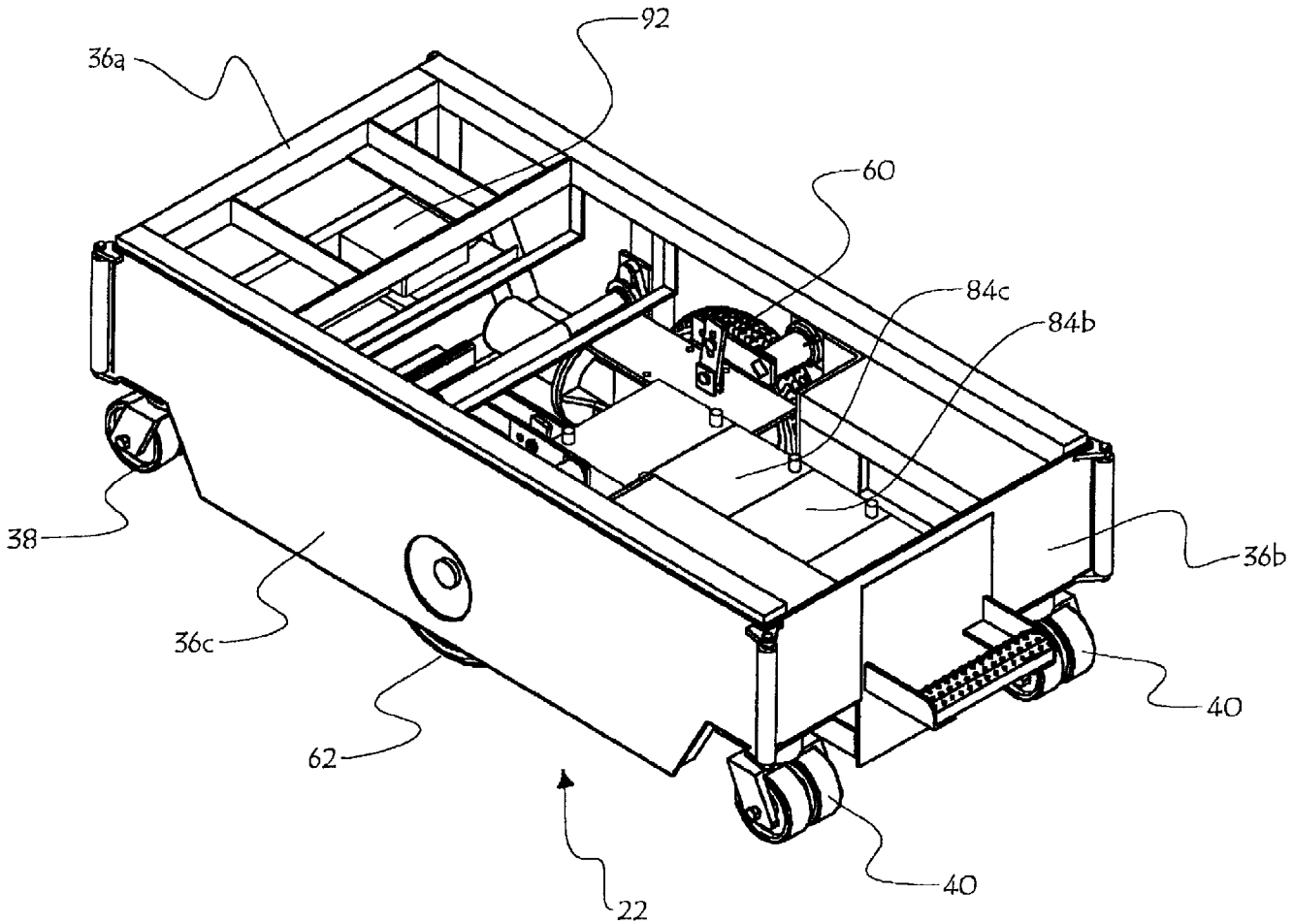
FIG. 4 is a rear perspective view of the vehicle carriage of FIG. 3.
Figure 5:
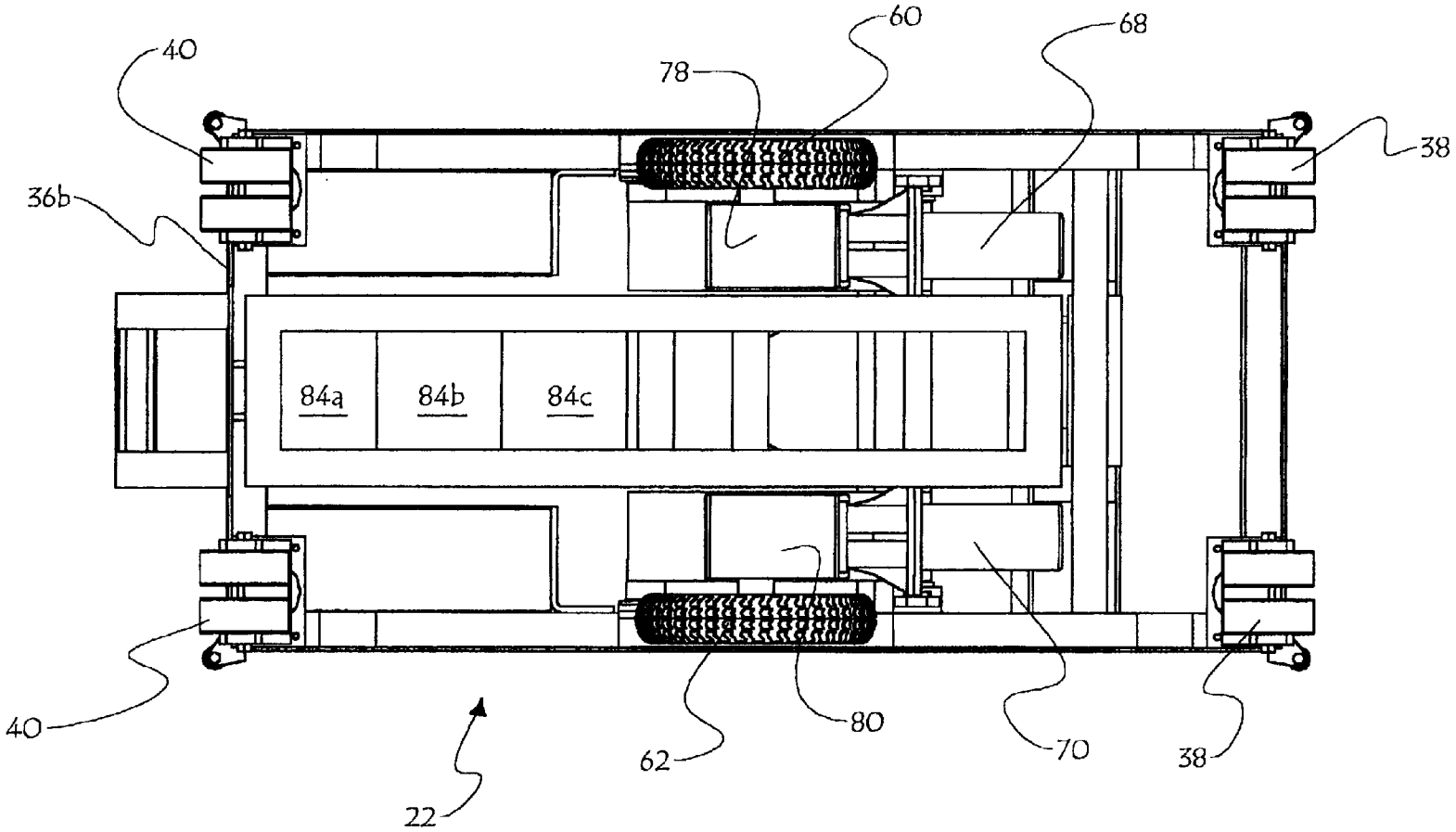
FIG. 5 is a bottom plan view of the vehicle carriage of FIG. 3.

As best shown in FIGS. 3–5 of the drawings, the ground carriage 22 further comprises a pair of laterally opposite side drive wheels 60, 62. Each drive wheel 60, 62, is mounted for relative movement to the intermediate section 36*c* of frame 36 of carriage 22 by a pivotal suspension assembly 64, 64. An electrical motor 68, 70, is mounted to a corresponding axle of each drive wheel 60, 62 respectively. Each motor 68, 70 is also pivotally mounted at one end to frame 36 by a support arm 72, at a registering ball bearing pivot mount 76, 76. To each motor 68, 70, is further associated a reduction gear assembly 78, 80. Each motor 68, 70, is also designed to provide torque brake, i.e. enabling to limit the speed of the vehicle 20 should the vehicle 20 roll at increasing speed along a downwardly sloping terrain. To enable vehicle 20 to turn, each motor 68, 70, should also be of the type that provides reversible output: i.e., can rotate the wheel axle drive shaft clockwise, or alternately counterclockwise, depending on the particular need.

Figure 2:
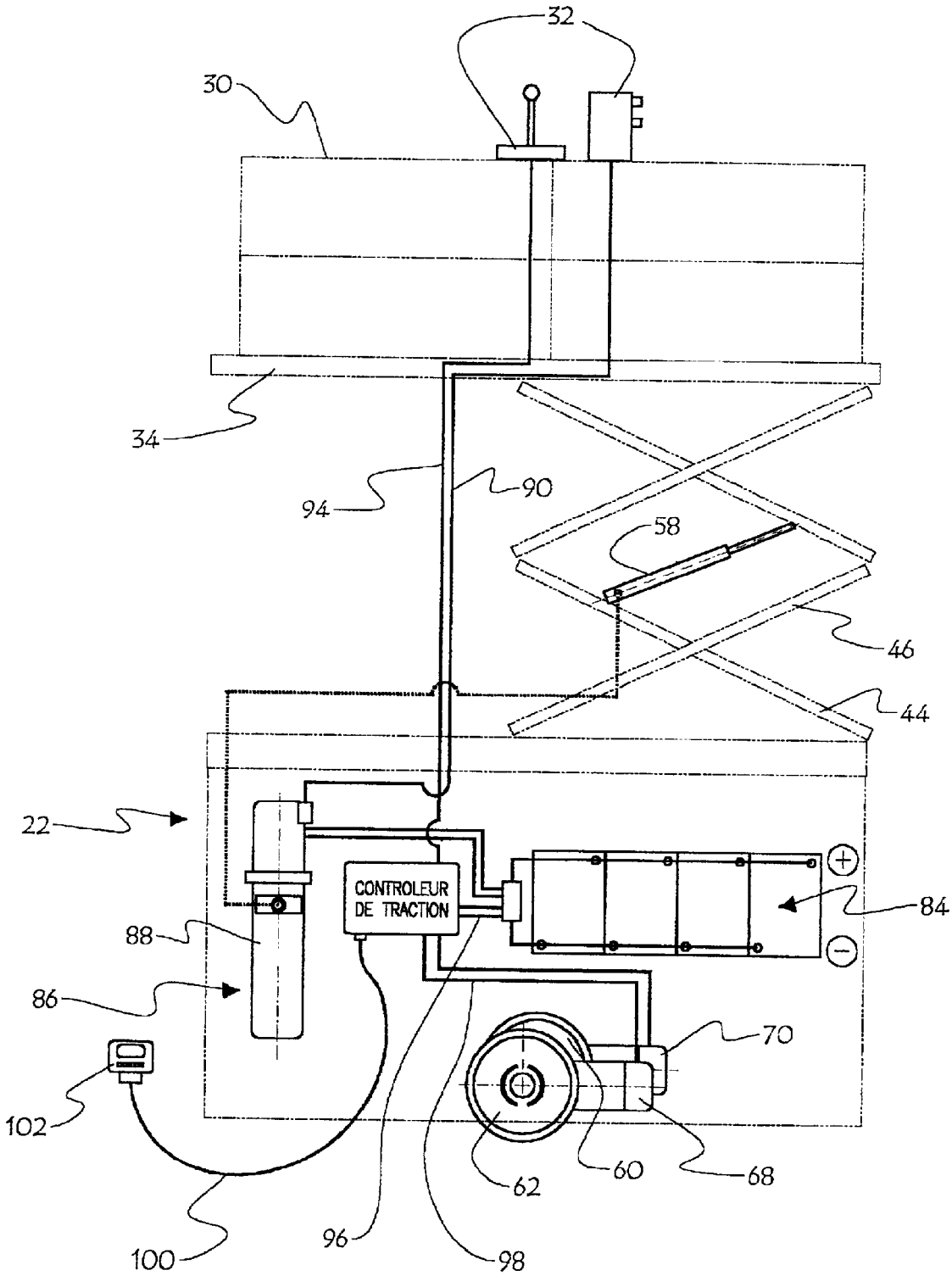
FIG. 2 is a schematic elevational view of this elevating platform vehicle, showing the electrical and hydraulic fluid lines.
Figure 6:
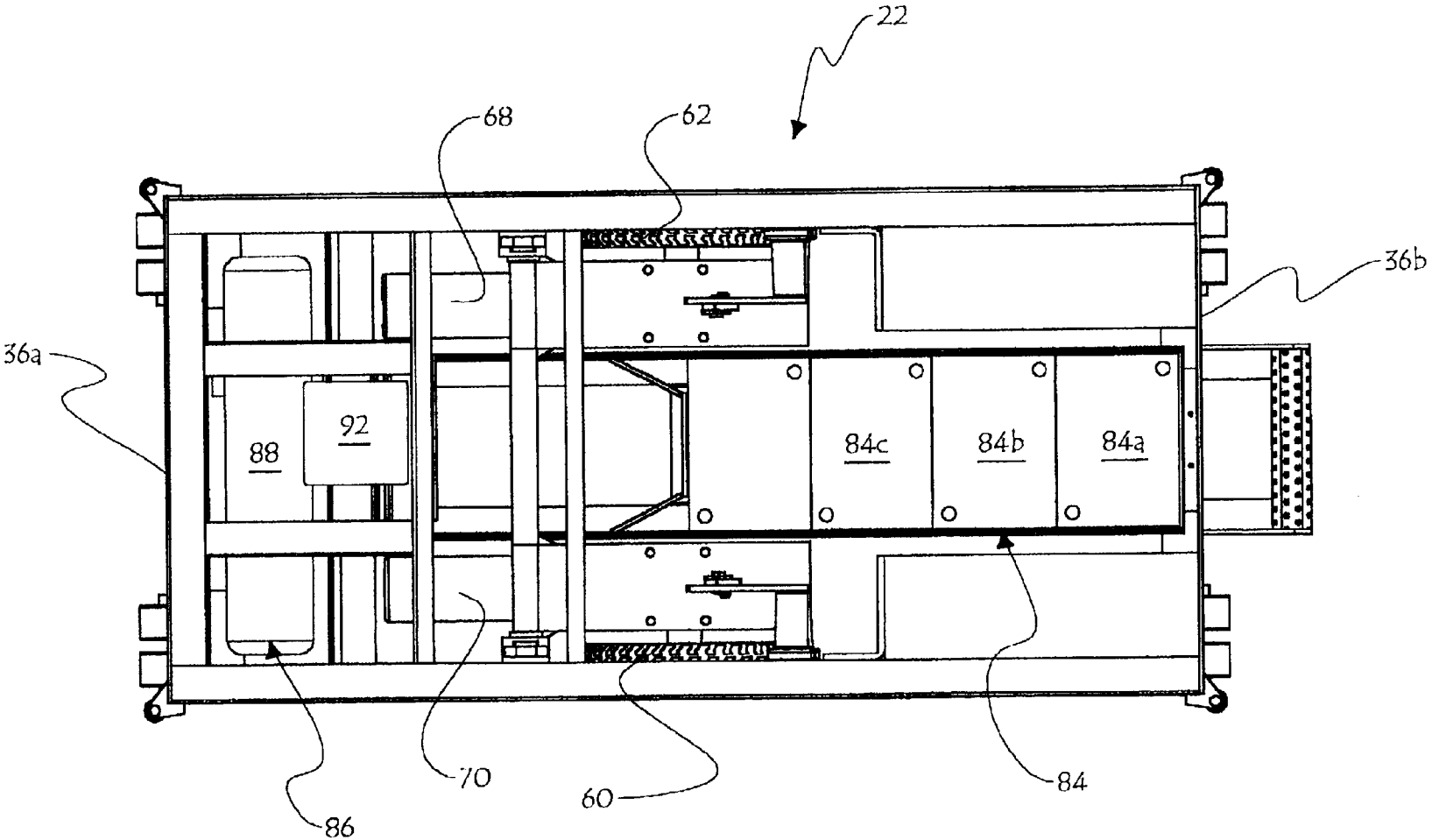
FIG. 6 is a top plan view of the vehicle carriage of FIG. 3.
Figure 7:
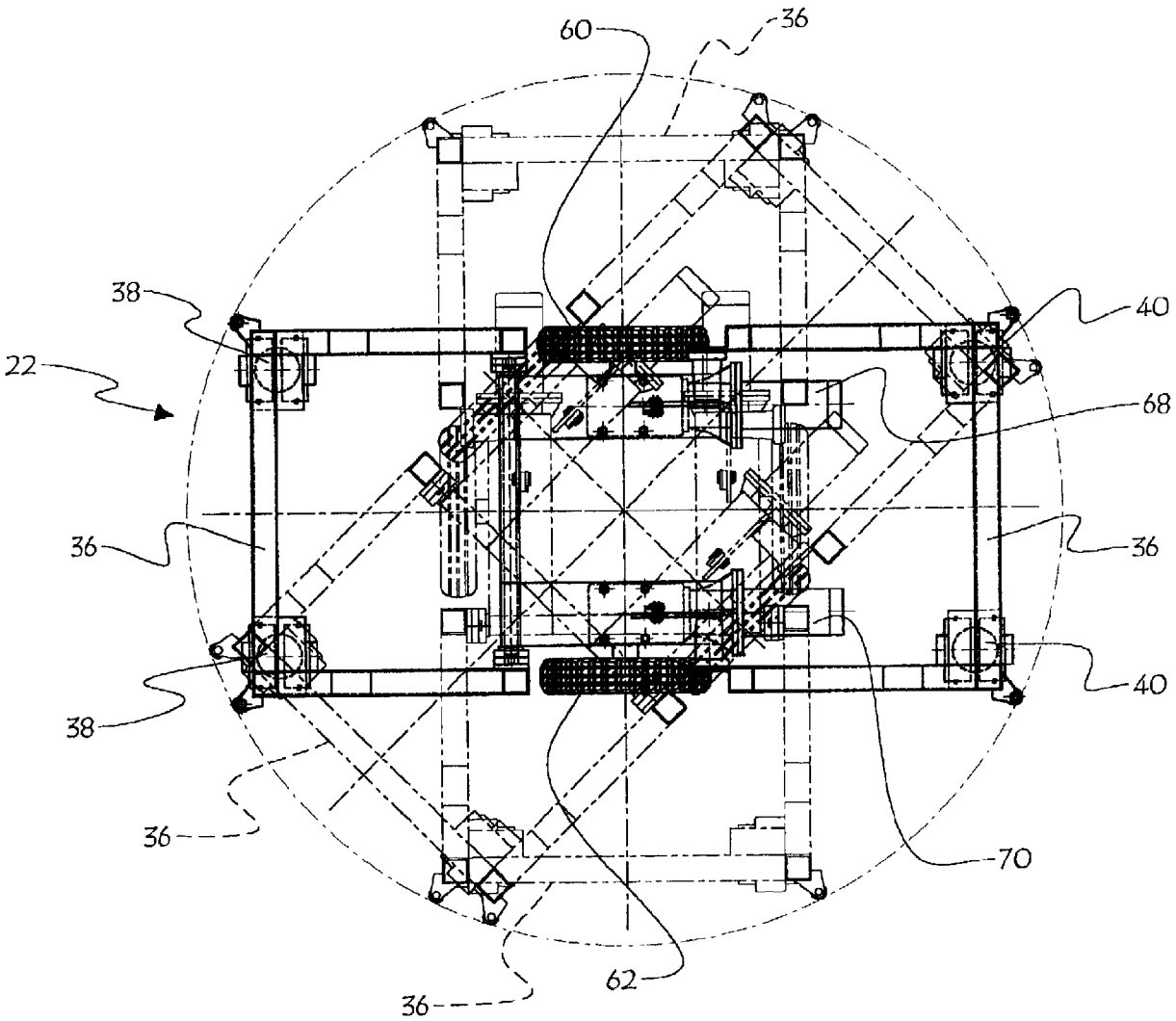
FIG. 7 is a schematic bottom plan view of the vehicle carriage of FIG. 3, and further showing in phantom lines a second vehicle carriage outline rotated 45 degrees relative to the full line vehicle, and a third vehicle carriage outline rotated 90 degrees relative to the original full line vehicle, so as to show the tight turning capability of the vehicle.

Clutch means, not shown, are preferably provided to manually release drive torque from the motors 68, 70, to the wheels 60, 62, if deactivation of the drive output of wheels 60, 62, is required. A battery unit 84 (FIG. 6), including for example a number of batteries 84*a*, 84*b*, 84*c*, . . . , is provided integral to frame 36, to provide an autonomous mobile power source for drive wheel motors 68, 70. A hydraulic fluid supply means 86 (FIG. 2) is also provided integral to frame 36, to power the hydraulic rams 58 for extension of the scissor linkage assembly 26. Fluid supply means 86 includes a hydraulic pump 88, a hydraulic fluid load, and a hydraulic fluid line 90 operatively interconnecting the pump 88 with the rams 58 and housing the fluid load therein.

A programmable electronic circuit 92 (FIG. 3) is also provided integral to frame 36, to provide control of traction with drive wheels 60, 62. As suggested in FIG. 2, electronic circuit 92 is operatively connected by a first line 94 to the platform remote control unit 32, by a second line 96 to the batteries 84, by a third line 98 to the electrical motors 68, 70, and by a fourth line 100 to a second ground remote control unit 102. A first operator O on raised platform 24 can thus perform control both traction of ground carriage wheels 60, 62, and extension/retraction of scissor-linkage assembly rams 58, via remote control unit 32 and electronic circuit 92. A second operator U (FIG. 1) on the ground may also perform control of wheel traction of wheels 60, 62, via remote control unit 102 and electronic circuit 92.

Figure 8:
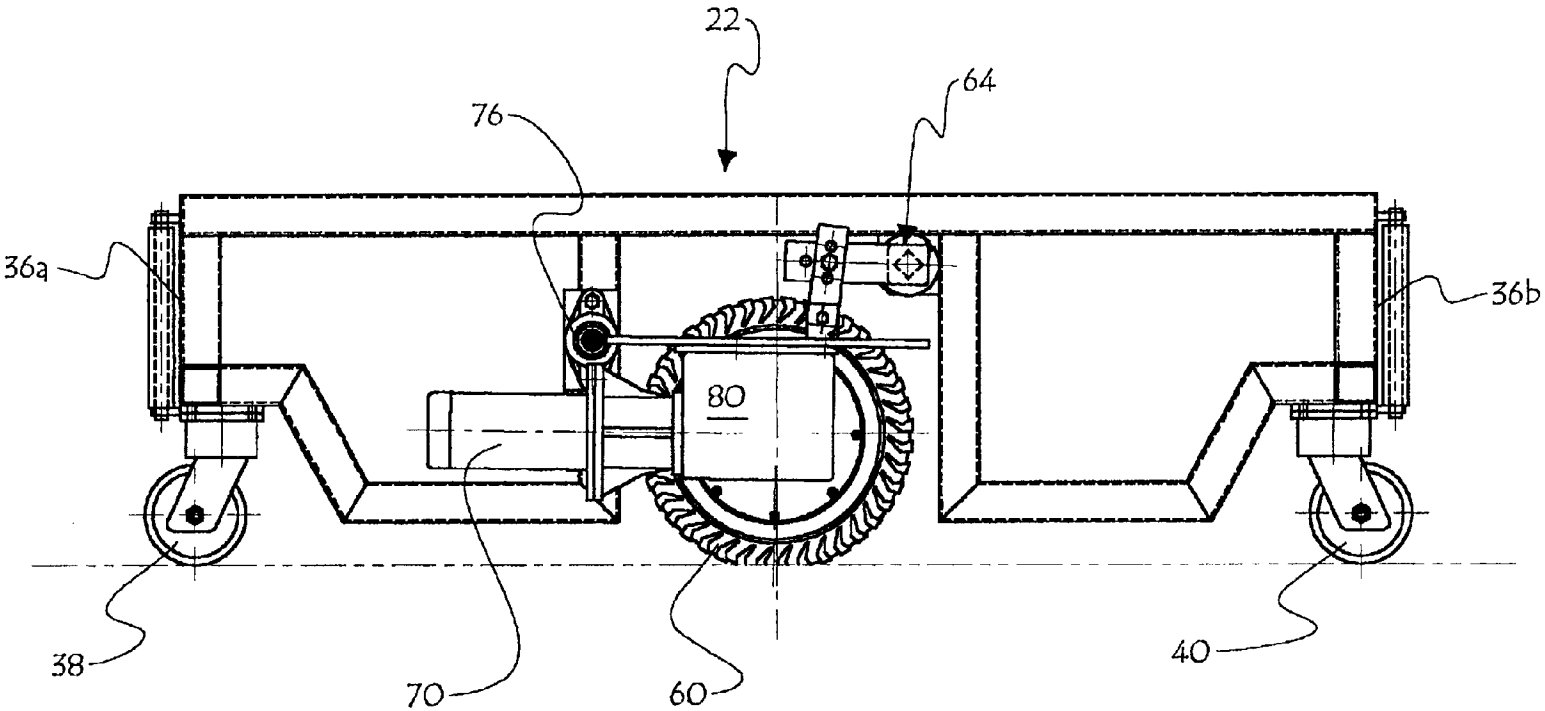
FIGS. 8 and 9 are vertical, fore and aft sectional views, of the vehicle carriage of FIG. 3, sequentially suggesting how the wheel drive axle can tilt relative to the vehicle carriage to accommodate uneven ground terrain.
Figure 9:
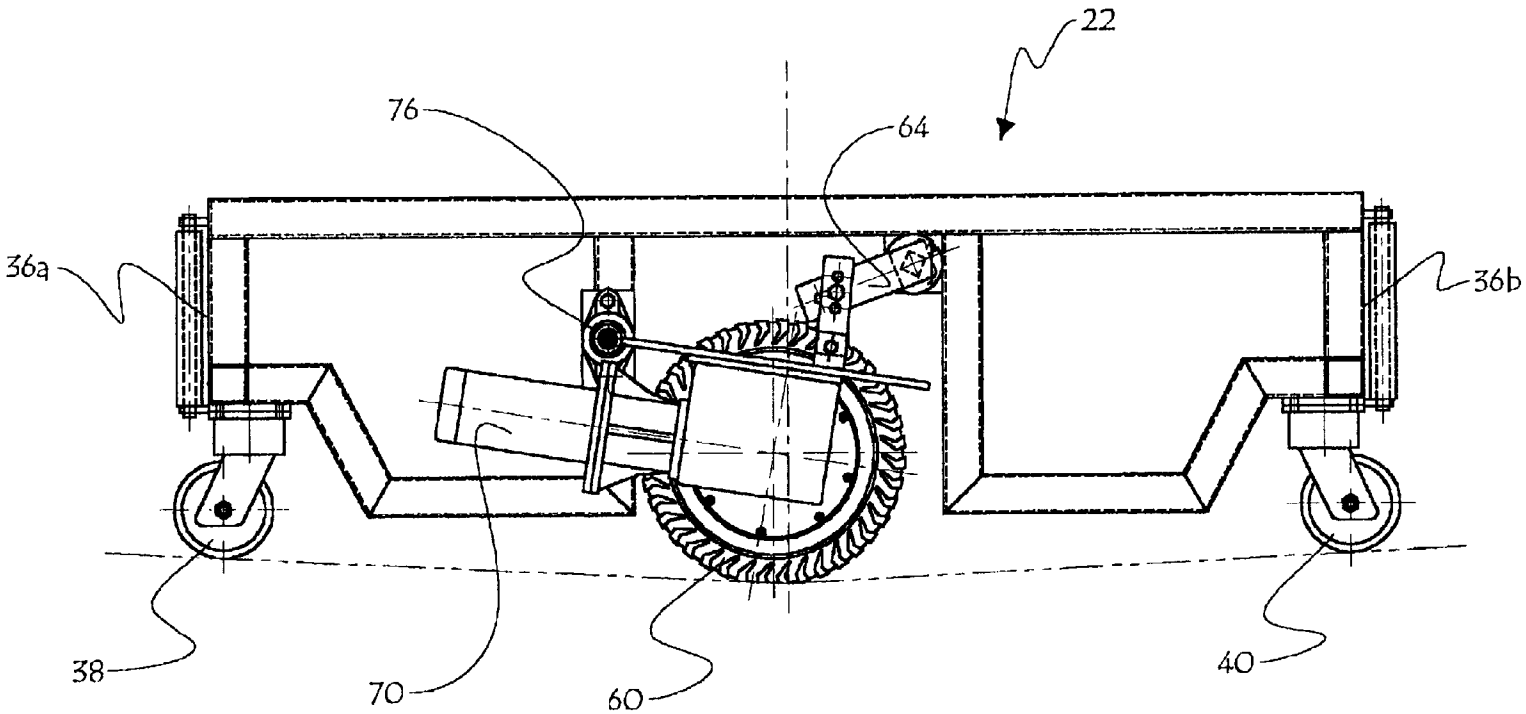

As suggested by the sequence illustrated in FIGS. 8 and 9, the axle of wheels 60 (62) may partly tilt about their pivot mounts 64, 76, so that wheels 60, 62, may extend downwardly through and beyond the plane intersecting the underface of peripheral casters 38, 40, to accommodate uneven ground terrain. This tilting capability of the axle of wheels 60, 62, provides greater stability to the vehicle 20.

In operation, vehicle 20 can be brought in forward or rearward motion over ground by either ground operator U, with remote control 102, or platform operator O, with remote control 32. This forward or rearward ground displacement of vehicle 20 is brought about by having both drive motors 68, 70, drive both wheels 60, 62, in the same direction. When vehicle 20 is to make a turn, command is sent via controls 32 or 102 to electronic circuit 92 and to one of the reduction gear units, 78 or 80, so that the rotational speed of one wheel 60 or 62 be slightly different—i.e., out of sync—from the other wheel. When vehicle 20 is to make a tight turn, for example turning onto itself without any effective forward or rearward motion, another command is sent via controls 32 or 102 to electronic circuit 92 and to the drive units 68, 70, so that one wheel, e.g. wheel 60 rotates in a first direction while another wheel, e.g. wheel 62, rotates in a second direction opposite said first rotation direction, wherein the vehicle 20 will be able to "turn on a dime".

Preferably for safety reasons, operator O will want to immobilize carriage 22 on the ground, before actuating the ram extension means 58 of scissor-linkage assembly 26 with remote control unit 32.

The embodiments of the invention, in which an exclusive property or privilege is claimed, are defined as follows:

1. A ground-movable carriage for supporting spacedly over ground a liftable platform with an extendable scissor linkage assembly, said carriage including:

a) a rigid main frame, defining a front portion, a rear portion, and a middle portion intermediate said front portion and said rear portion;

b) a first pair of ground-engageable front pivotal casters, rotatably mounted to said main frame front portion in laterally spaced apart fashion;

c) a second pair of ground-engageable rear pivotal casters, rotatably mounted to said main frame rear portion in laterally spaced fashion;

d) a ground-engageable omnidirectional drive wheel assembly, mounted for relative movement to said main frame middle portion; and c) a power unit, operatively connected to said drive wheel assembly and powering said drive wheel assembly in moving said carriage rollingly over ground;

wherein said drive wheel assembly can provide full turn rotation of said carriage without fore and aft motion;

wherein said drive wheel assembly includes a first wheel axle and a second wheel axle, each of said first wheel axle and second wheel axle being independently articulated to said carriage main frame by first pivot mount system and by a second pivoted suspension system; and further including a first reduction gear assembly, connected to said first wheel axle, and a second reduction gear assembly, connected to a said second wheel axle; and wherein said power unit includes a first motor, connected to said first wheel axle and cooperating with said first reduction gear assembly, and a second motor, connected to said second wheel axle and cooperating with said second reduction gear assembly; at least one of said first motor and second motor providing reversible torque output.

2. A carriage as in claim 1, further including an electronic circuit, operatively interconnecting said first and second motors, said first and second reduction gears, and said remote control device, said electronic circuit controlling direction of rotation of each of said first wheel axle and second wheel axle.

3. A ground-movable load-lifting vehicle for lifting a load over ground, said vehicle comprising:

a) a platform bed, for supporting and containing a load spacedly over ground;

b) a ground-movable carriage, including a rigid main frame defining a front portion, a rear portion, and a middle portion intermediate said front portion and said rear portion;

c) a scissor linkage assembly, supporting said platform bed spacedly over said carriage, said scissor linkage assembly including a first pivot mount, pivotally interconnecting a top end of said scissor linkage assembly to said platform bed, a second pivot mount, pivotally interconnecting a bottom end of said scissor linkage assembly to said carriage, and ram means for power extending said scissor linkage assembly against the bias of the load supported by said platform bed;

wherein said carriage further includes:

a first pair of ground-engageable front pivotal casters, rotatably mounted to said main frame front portion in laterally spaced apart fashion;

a second pair of ground-engageable rear pivotal casters, rotatably mounted to said main frame rear portion in laterally spaced fashion;

d) a ground-engageable omnidirectional drive wheel assembly, mounted for relative movement to said main frame middle portion; and c) a power unit, operatively connected to said drive wheel assembly and powering said drive wheel assembly in moving said carriage rollingly over ground;

wherein said drive wheel assembly can provide full turn rotation of said carriage without fore and aft motion;

wherein said drive wheel assembly includes a first wheel axle and a second wheel axle, each of said first wheel axle and second wheel axle being independently articulated to said carriage main frame by a first pivot mount system and by a second pivoted suspension system.

4. A load lifting vehicle as in claim 3, further including a manual remote-control device, mounted to said platform bed and operatively connected to said power unit and remotely actuating said drive wheel assembly.

5. A load-lifting vehicle as in claim 4, further including a first reduction gear assembly, connected to said first wheel axle, and a second reduction gear assembly, connected to said second wheel axle; and wherein said power unit includes a first motor, connected to said first wheel axle and cooperating with said first reduction gear assembly, and a second motor, connected to said second wheel axle and cooperating with said second reduction gear assembly; at least one of said first motor and second motor providing reversible torque output.

6. A load-lifting vehicle as in claim 5, further including an electronic circuit, operatively interconnecting said first and second motors, said first and second reduction gears, and said remote control device, said electronic circuit controlling direction of rotation of each of said first wheel axle and second wheel axle.

7. A load-lifting vehicle as in claim 4, wherein said ram means are operatively connected to said power unit and to said remote control device, said power unit controlling said ram means concurrently with said drive wheel.

8. A ground movable-load-lifting vehicle for lifting a load over ground, said vehicle comprising:

a) a platform bed, for supporting and containing a load spacedly over ground;

b) a ground-movable carriage, including a rigid main frame defining a front portion, a rear portion, and a middle portion intermediate said front portion and said rear portion;

d) a scissor linkage assembly, supporting said platform bed spacedly over said carriage, said scissor linkage assembly including a first pivot mount, pivotally interconnecting a top end of said scissor linkage assembly to said platform bed, a second pivot mount, pivotally interconnecting a bottom end of said scissor linkage assembly to said carriage, and ram means for power extending said scissor linkage assembly against the bias of the load supported by said platform bed;

wherein said carriage further includes:

a first pair of ground-engageable front pivotal casters, rotatably mounted to said main frame front portion in laterally spaced apart fashion;

a second pair of ground-engageable rear pivotal casters, rotatably mounted to said main frame rear portion in laterally spaced fashion;

d) a ground-engageable omnidirectional drive wheel assembly, mounted for relative movement to said main frame middle portion; and c) a power unit, operatively connected to said drive wheel assembly and powering said drive wheel assembly in moving said carriage rollingly over ground;

wherein said drive wheel assembly can provide full turn rotation of said carriage without fore and aft motion;

further including tilt means, cooperating with said drive wheel assembly in enabling downward tilt of said drive wheel assembly to accommodate uneven ground surface.

9. A ground-movable load-lifting vehicle for lifting a load over ground, said vehicle comprising:

a) a platform bed, for supporting and containing a load spacedly over ground;

b) a ground-movable carriage, including a rigid main frame defining a front portion, a rear portion, and a middle portion intermediate said front portion and said rear portion;

c) a scissor linkage assembly, supporting said platform bed spacedly over said carriage, said scissor linkage assembly including a first pivot mount, pivotally interconnecting a top end of said scissor linkage assembly to said platform bed, a second pivot mount, pivotally interconnecting a bottom end of said scissor linkage assembly to said carriage, and ram means for power extending said scissor linkage assembly against the bias of the load supported by said platform bed;

wherein said carriage further includes:

a first pair of ground-engageable front pivotal casters, rotatably mounted to said main frame front portion in laterally spaced apart fashion;

a second pair of ground-engageable rear pivotal casters, rotatably mounted to said main frame rear portion in laterally spaced fashion;

d) a ground-engageable omnidirectional drive wheel assembly, mounted for relative movement to said main frame middle portion; and e) a power unit, operatively connected to said drive wheel assembly and powering said drive wheel assembly in moving said carriage rollingly over ground;

wherein said drive wheel assembly can provide full turn rotation of said carriage without fore and aft motion;

further including an electronic circuit, integral to said carriage main frame and operatively interconnecting said ram means and said power unit, wherein said drive wheel assembly of the carriage and said ram means of the scissor linkage assembly are selectively controled by said electronic circuit independently of one another.

* * * * *